United States Patent [19]

Shank et al.

[11] 4,410,305

[45] Oct. 18, 1983

[54] VANE TYPE COMPRESSOR HAVING ELLIPTICAL STATOR WITH DOUBLY-OFFSET ROTOR

[75] Inventors: Wayne C. Shank, Tucson, Ariz.; Thomas C. Edwards, Rockledge, Fla.

[73] Assignee: Rovac Corporation, Rockledge, Fla.

[21] Appl. No.: 271,399

[22] Filed: Jun. 8, 1981

[51] Int. Cl.[3] ..... F04C 18/00

[52] U.S. Cl. ..... 418/150; 418/264

[58] Field of Search ..... 418/150, 259–264

[56] References Cited

U.S. PATENT DOCUMENTS

| | | | |
|---|---|---|---|
| 3,890,071 | 6/1975 | O'Brien | 418/260 |
| 3,917,438 | 11/1975 | Glanvall | 418/259 |
| 4,088,426 | 5/1978 | Edwards | 418/264 |

FOREIGN PATENT DOCUMENTS

| | | | |
|---|---|---|---|
| 2725238 | 12/1977 | Fed. Rep. of Germany | 418/259 |
| 286240 | 8/1927 | United Kingdom . | |
| 313054 | 4/1930 | United Kingdom . | |
| 993874 | 6/1965 | United Kingdom . | |
| 1428279 | 3/1976 | United Kingdom . | |
| 1429248 | 3/1976 | United Kingdom . | |

*Primary Examiner*—John J. Vrablik

*Attorney, Agent, or Firm*—Leydig, Voit, Osann, Mayer and Holt

[57] ABSTRACT

A rotary compressor having a housing defining a chamber with a curved outer wall of substantially elliptical profile containing a rotor of cylindrical shape having a plurality of vanes profiled to fit the chamber and radially slidable in grooves in the rotor to define enclosed compartments between them. Each vane has a pair of axially extending stubshafts having rollers respectively mounted thereon. Roller tracks formed in the end walls of the chamber accommodate the rollers for guiding the vanes so that the outer edges of the vanes follow the outer wall of the chamber in closely spaced engagement. Inlet and outlet ports located in the curved outer wall of the chamber closely straddle a reference region. The rotor has its axis laterally offset from the chamber for engagement at the reference region for sealing between the ports, the rotor axis being offset toward the outlet port and being spaced along both the major and minor axes of the elliptical profile by sufficient amounts that each vane undergoes but a single in and out stroke during each revolution of the rotor notwithstanding the elliptical nature of the chamber. In the preferred construction the rollers ride in grooves having radially opposed walls formed in the respective end walls of the chamber, with the radially inward wall having substantially constant radial clearance with respect to the contained rollers thereby to determine the amount that each vane can move radially inward under starting conditions and in the face of "slugging".

8 Claims, 9 Drawing Figures

20
21
23
24
25
31
32
33
34
35
37
38
38a
39
40
41
42
54
56
64
66
67
68
69
ROLLER CLEARANCE
1.

20
21
25
26
27
28
35
39
40
51
52
53
54
55
56
61
62
63
64
65
66
68
69
70
71
72
73
74
2.
6.

FIG. 3
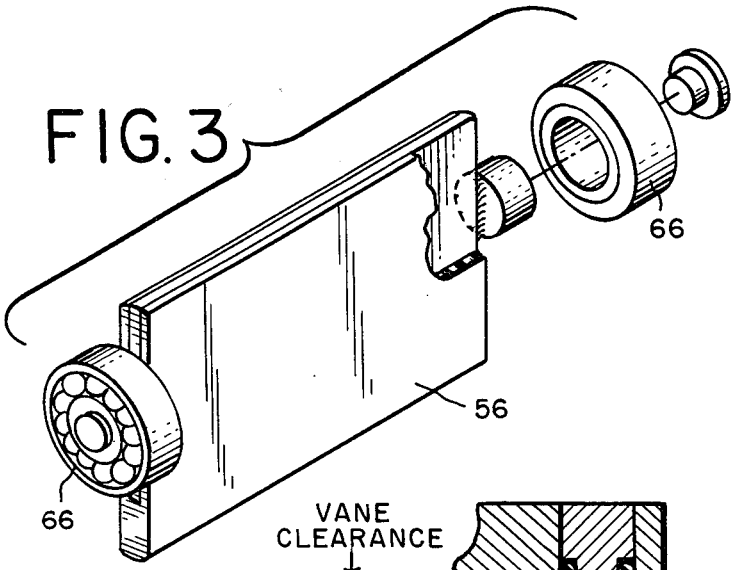
FIG. 6
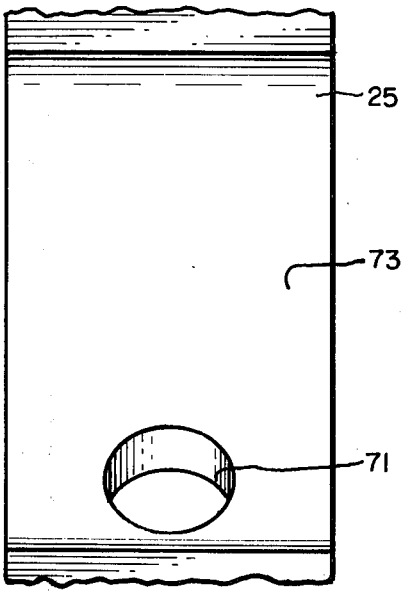
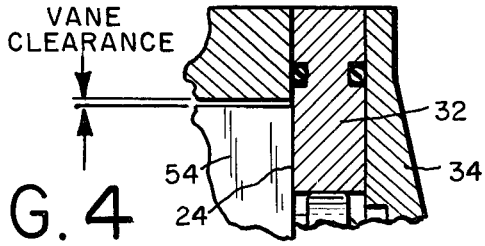
FIG. 4
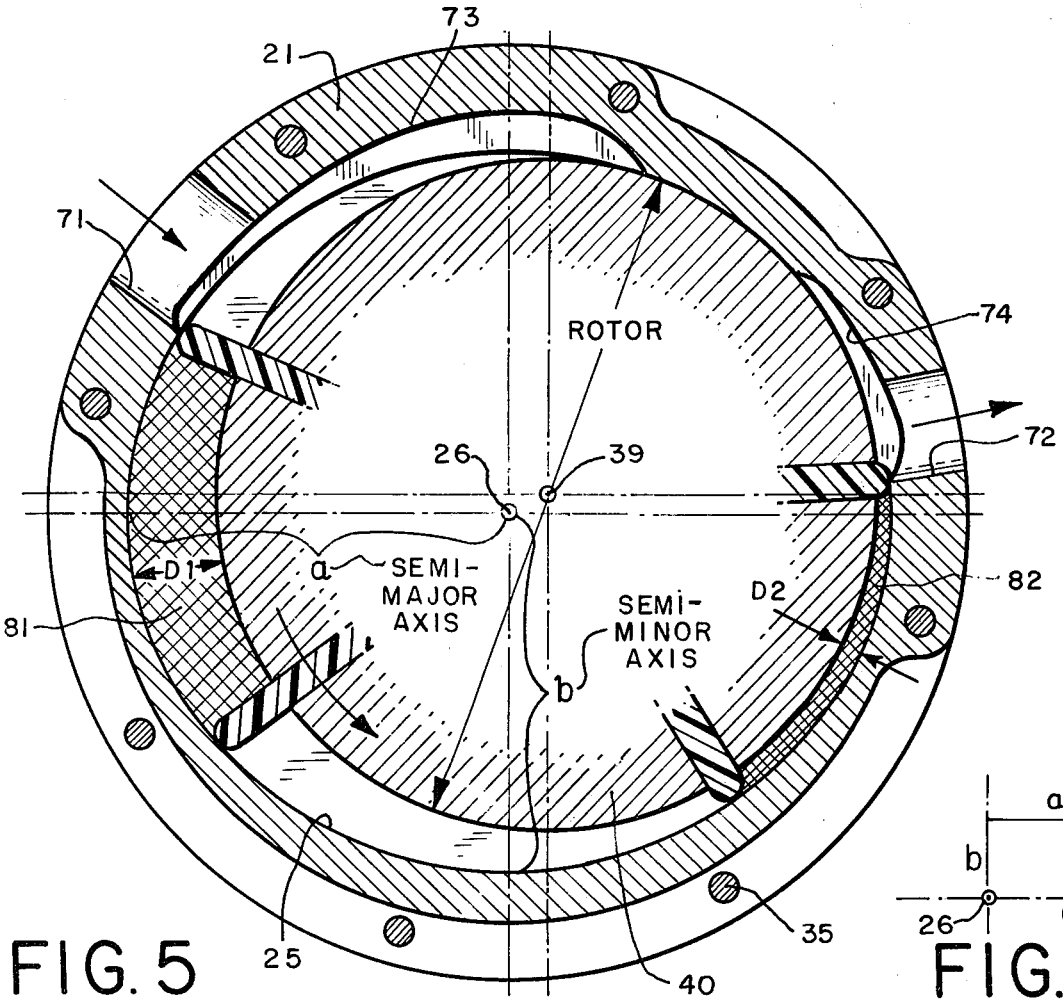
FIG. 5
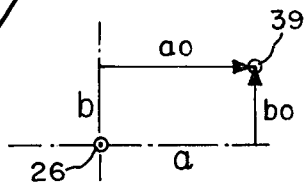
FIG. 5a FIG. 7
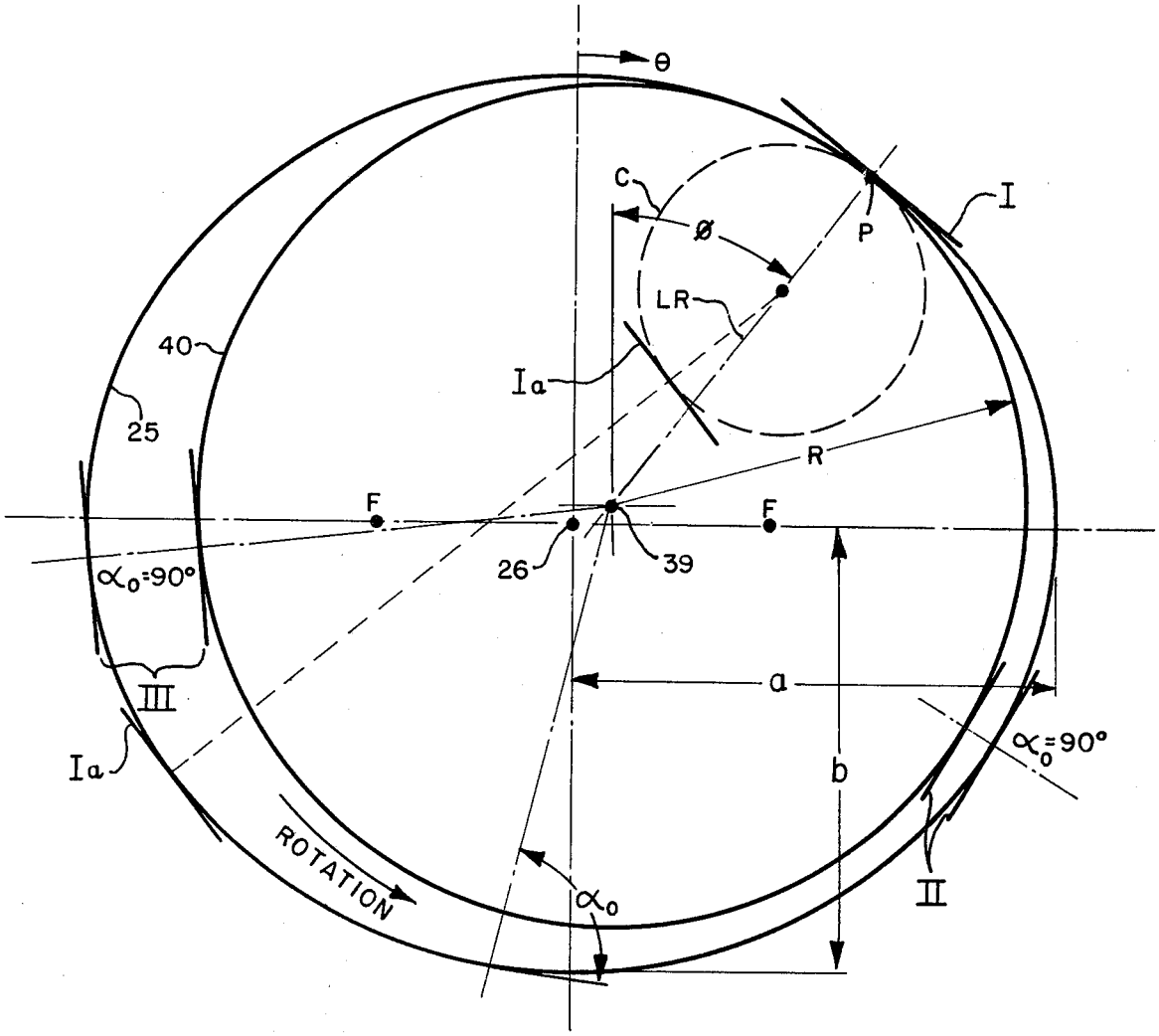
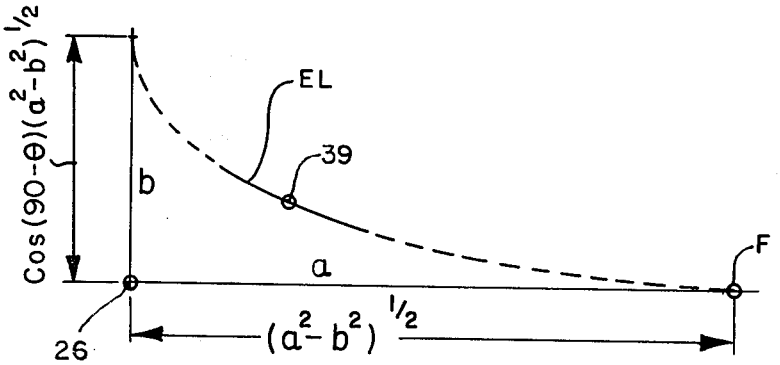
FIG. 7a

VANE TYPE COMPRESSOR HAVING ELLIPTICAL STATOR WITH DOUBLY-OFFSET ROTOR

In a conventional compressor of the rotary vane type a circular rotor rotates in a circular chamber with the vanes pressing against the curved outer wall of the chamber and with ports in the end walls.

In our copending application Ser. No. 157,564 entitled "Vane Type Compressor Employing Elliptical-Circular Profile", which was filed June 16, 1980, now U.S. Pat. No. 4,299,097, there is shown a vane type compressor in which the vanes are individually supported on rollers that ride along tracks formed in the end walls of a chamber, the rollers serving to guide the vanes in closely spaced engagement with the curved wall of the chamber. Inlet and outlet ports are formed in the curved wall. In that construction the curved wall of the chamber is elliptical on the inlet side and circular on the outlet side. Such construction, at the regions of merging of the circle and ellipse, results in a mathematical discontinuity of curvature making the surface difficult to generate and giving rise to problems such as vibration and "vane jump".

It is an object of the present invention to provide a compressor of the vane type having a circular rotor operating in a chamber which is of substantially elliptical profile on both the inlet and outlet sides. Thus it is an object to provide a vane type compressor having a geometry such that smooth and efficient operation is achieved over a wide speed range.

It is a more specific object of the invention to provide a vane type compressor including a circular rotor operating in an elliptical chamber with the rotor axis being offset from both the major and minor axes of the ellipse, and in the direction of the outlet port, so that the vane motion is limited to but a single in and out stroke of each rotative cycle of the shaft.

It is a more specific object of the invention to provide a vane type compressor having an elliptical chamber in which the reciprocation of the vanes occurs smoothly over a wide speed range thereby overcoming a tendency for the vanes, under certain conditions of speed and pressure, to "jump" clear of the curved wall of the chamber. In short the "jump speed" is lowered to a point well under the normal range of operating speed.

It is a specific object of the present invention to provide a vane type compressor in which the chamber is so profiled and the rotor is so located as to bring about a rate of change of volume which is small over the terminal portion of the stroke, reaching substantially zero at the threshold of the outlet port, thereby providing a lower and more constant rate of flow through the outlet port as well as a high mechanical advantage and more constant torque loading over a complete rotative cycle.

It is a general object to provide a vane type compressor which operates at a high efficiency, which has inherently low friction both per pound of mass flow or per unit of swept displacement, and which works particularly well with vapor type refrigerants of the low vapor pressure, high boiling point type.

Indeed, it is an object of the invention in one of its aspects that the vane type compressor may be accommodated to low vapor pressure refrigerants either by increasing the shaft speed or by scaling up the size or by a combination of the two. It is a related object to provide a design of vane type compressor in which the size may be scaled up as desired without the usual sacrifice in efficiency by reason of port losses and increased friction. It is a related object to provide a vane type compressor for use in a vapor refrigeration system and which is ideally suited to the use of many non-fluorocarbon refrigerants thereby avoiding the hazard to the environment which exists with use of refrigerants of the fluorocarbon type.

It is yet another object of the invention to provide a vane type compressor in which the vanes are positively guided in closely spaced running engagement with the curved wall of the chamber but in which there is provision for inward movement of the vanes both as a way of reducing the compression starting load and for preventing damage as a result of "slugging" of liquid refrigerant.

It is a general object of the invention to provide a vane type compressor which is more efficient than vane type compressors used in the past but which is of simple and highly economical construction. Thus it is an object to provide a compressor of the vane type which is not only economical in first cost but economical in operation, requiring very little maintenance and capable of operating trouble-free over long periods of time. In this connection it is an object to provide a vane type compressor which, when operated with low vapor pressure refrigerants, permits use of more liberal tolerances, and remains tight and free of the usual leakage, particularly in the region of the seals, to which more conventional devices are subject.

Other objects and advantages of the invention will become apparent upon reading the attached detailed description and upon reference to the drawings in which:

FIG. 3 shows a typical vane and its supporting rollers in perspective and with a portion broken away.

FIG. 4 is a fragment showing vane tip clearance and based on FIG. 2.

FIG. 5 is a transaxial section parallel to that shown in FIG. 1 but diagrammatic to show the geometry of the construction, with the paired vanes defining (shaded) inlet and outlet compartments.

FIG. 5*a* shows, in enlarged degree, the lateral offset of the rotor axis with respect to the chamber axis.

Figure 1:
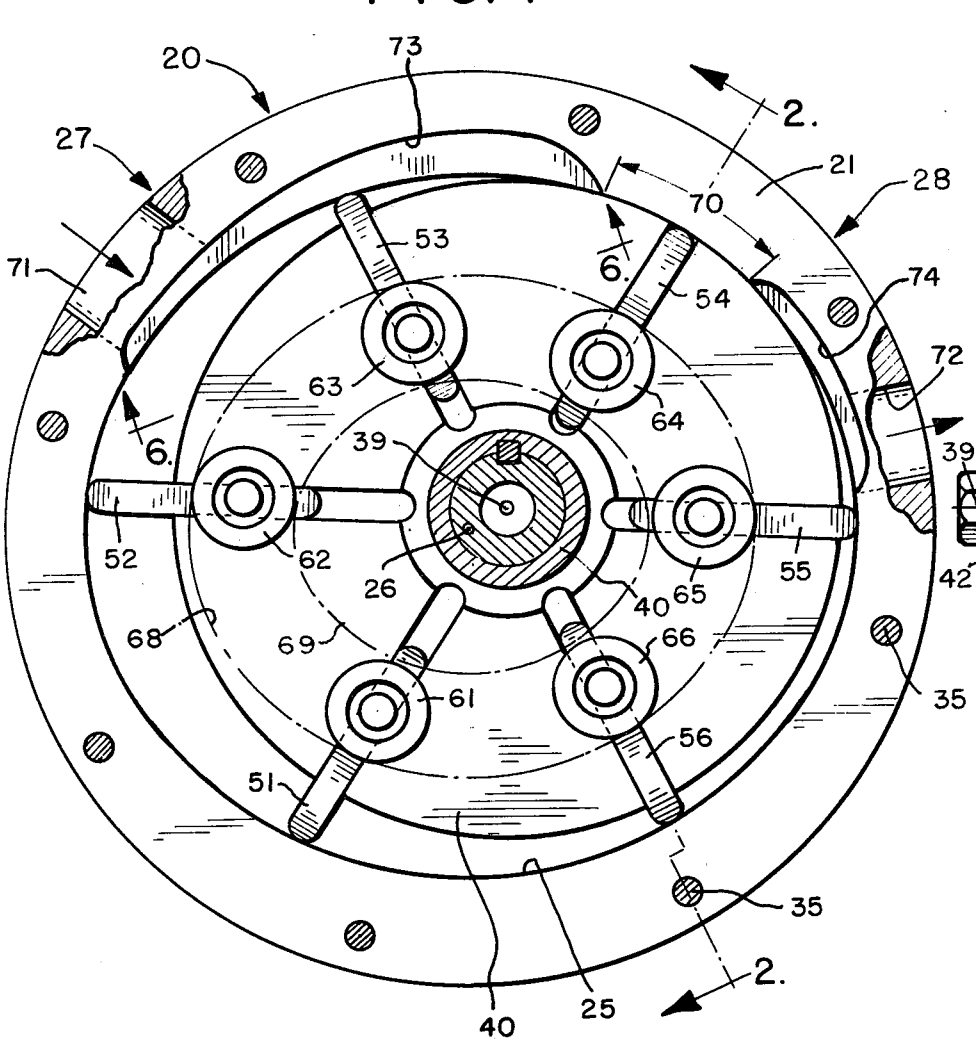
FIG. 1 is a vertical, transaxial section of the compressor constructed in accordance with the present invention as viewed along section line 1—1 in FIG. 2.

FIG. 6 is a fragmentary section looking along line 6—6 in FIG. 1 showing the pocket associated with the inlet port.

FIG. 7 is a construction diagram showing the three locations of parallelism which distinguish a compressor constructed in accordance with the present invention.

FIG. 7*a* is a diagram showing the locus of the rotor axis relative to the elliptical stator.

While the invention has been described in connection with a preferred embodiment, it will be understood that we do not intend to be limited to the particular embodiment shown but intend, on the contrary, to cover the various alternative and equivalent forms of the invention included within the spirit and scope of the appended claims.

Figure 2:
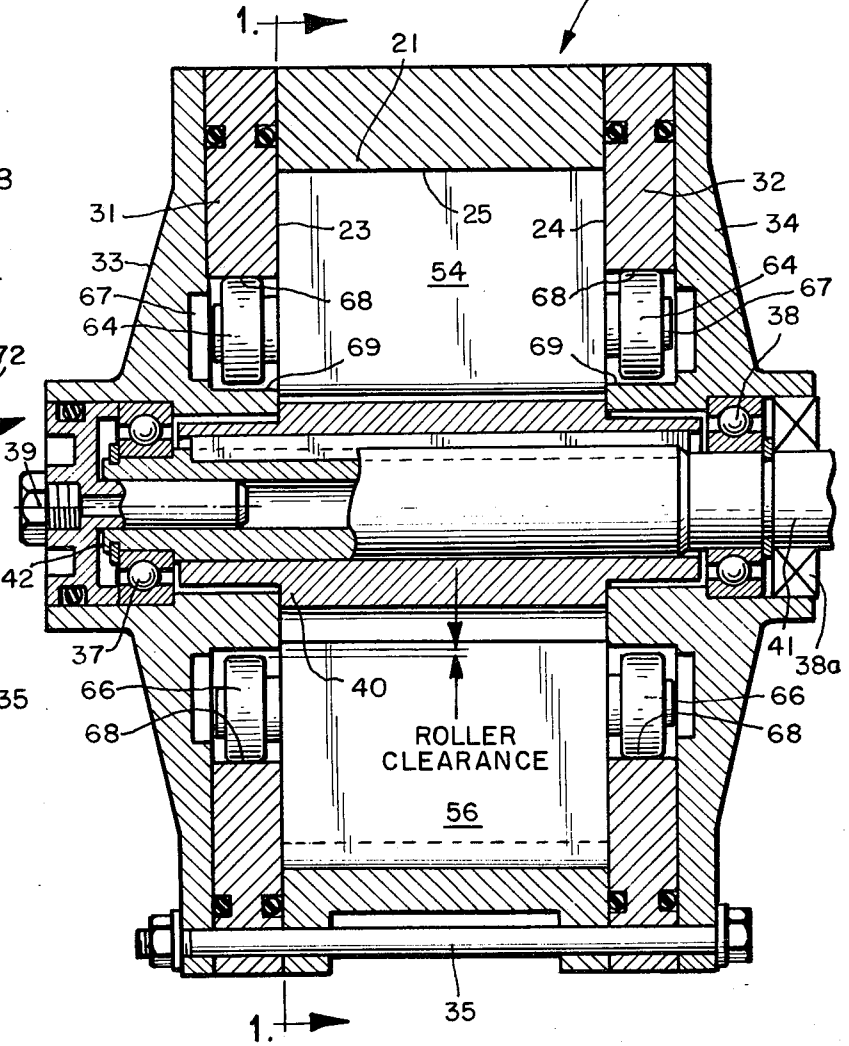
FIG. 2 is a section parallel to the axis as viewed along line 2—2 in FIG. 1.

Turning now to the drawings there is disclosed in FIGS. 1 and 2 a compressor 20 comprising a housing 21 defining a chamber having opposed parallel end walls 23, 24 and a curved smoothly continuous outer wall 25 centered about a chamber axis 26. For convenience the chamber will be divided into an inlet or left-hand side 27 and an outlet or right-hand side 28.

Forming the end walls 23, 24 of the chamber are end plates 31, 32 which are respectively mounted upon end bells 33, 34 which are clamped together by bolts 35. The end bells carry anti-friction bearings 37, 38 and an associated seal 38*a* centered about a rotor axis 39.

The bearings 37, 38 serve to journal a rotor 40 of cylindrical shape supported upon a shaft having a driving end 41 and a remote end 42. The rotor, dimensioned to fit between the end walls, has a plurality of equally spaced radially extending grooves. Occupying the grooves for sliding movement in the radial direction are a set of vanes 51–56 of rectangular shape profiled to fit the chamber to define enclosed compartments between them.

Each vane (see FIG. 3) has a pair of axially extending, aligned stub shafts having rollers mounted thereon. Each set of rollers, indicated at 61–66, is guided in a groove 67 having parallel side walls 68, 69. The outer side walls 68 form tracks for the vane rollers, the tracks being so profiled that when the vanes are urged outwardly by centrifugal force the outer edges of the vanes follow in closely spaced proximity to the outer wall 25 of the chamber (see FIG. 4).

There is provided, on the inlet side 27 of the chamber, an inlet port 71 for aspiration of gas into each compartment between adjacent vanes. On the outlet side 28 there is provided an outlet port 72 for discharging gas from each compartment in the compressed state. The curved outer wall 25 is "cylindrically" recessed (see FIG. 6) to provide peripheral pockets, 73, 74, respectively, which extend the ports so that they closely straddle a reference region 70 which is angularly offset from the top of the housing in the direction of the outlet port 72.

In accordance with the present invention the rotor has its axis 39 laterally offset from the chamber axis 26 to produce sealing engagement, at the reference region 70, between the rotor and the outer wall of the chamber, with the rotor axis being offset toward the outlet port and the rotor axis being spaced along both the major and minor axes of the elliptical profile by a sufficient amount that each vane undergoes but a single in and out stroke during each revolution of the rotor, notwithstanding the fully elliptical nature of the chamber.

The amount of lateral offset along the major axis is approximately twice the amount of offset along the minor axis so that the reference sealing region 70 between the ports is displaced by a substantial angle, in the direction of the outlet port, from the minor axis of the ellipse.

Referring to FIGS. 5, 5*a*, and 7 the geometry which characterizes the present invention will become more clear. The circular rotor 40 is shown contacting the elliptical wall 25 at the reference region 70, with the rotor axis 39 being offset along the major axis a by an amount ao and offset along the minor axis b by an amount bo, the ratio between the two being approximately two-to-one.

In accordance with one of the aspects of the present invention the length of the semi-major and semi-minor axes, indicated at a and b, are so proportioned as to produce an eccentricity within the range of 15 degrees to 45 degrees and which lies preferably within the range of 20 degrees to 30 degrees, 22.4 degrees being chosen. The eccentricity will be defined as the arc cosine of the ratio b/a.

It is one of the features of the present construction that the rotor is sufficiently large so that there are three positions about the circumference where tangents to the rotor and the curved wall of the chamber are parallel to one another. The sets of parallel tangents are indicated at I, II, III, respectively (FIG. 7).

In designing a compressor in accordance with our teachings the following procedure is used: First the size of the elliptical chamber and its eccentricity are postulated. Next the point P, which is the point of tangency in the reference region, is located, preferably at an angle of depression $\phi$ on the order of 42 degrees. The tangent to the ellipse is struck at the point P as indicated at I and the line LR is constructed perpendicular to the tangent, the line being the locus of the rotor axis 39.

Next a circle C is drawn representative of a rotor and preferably of small size. It is found that there will be only two positions about the circumference where the tangents to the rotor and the curved wall of the chamber are parallel to one another. These are the positions I and $I_a$, $I_a$, the latter lying respectively on the rotor circle C and on the locus of the surface 25.

Successively larger circles C are drawn, representative of the rotor, until a condition is achieved where there are three positions about the circumference where the tangents to the rotor and the curved wall of the chamber are parallel to one another as indicated at I, II and III, respectively. Such construction directs a rotor having a radius R.

We have found that there are a series of doubly-offset rotor centers which will produce but a single in and out stroke during each revolution of the rotor in an elliptical stator having semi-major and semi-minor axes a and b, respectively, and that such rotor centers, for various possible angular positions of the initially selected point P, lie on a quadrant of an elliptical locus EL, with the quadrant being defined as set forth in FIG. 7*a*. The elliptical locus EL has a semi-major axis which is equal to the focal radius (related to axis 26) of the focus F of the elliptical stator surface 25. Further, the elliptical locus EL has an elliptical eccentricity which is the complement of the eccentricity of the elliptical stator. Thus, in the present example, where the elliptical stator surface 25 has an eccentricity of 22.4 degrees, the eccentricity of the elliptical locus EL, on which the rotor center 39 is located, is 67.6 degrees.

Following the above teachings results in a compressor having a number of significant features and advantages. In the first place, notwithstanding the elliptical nature of the chamber, which would normally be expected to produce two in-and-out cycles of motion during each revolution of the shaft, each vane, in fact, undergoes but a single in-and-out reciprocation, thereby reducing vibration, enabling operation at a higher rotative speed, and reducing the amount of energy wasted in the radial acceleration of the vanes.

Other inherent features will be understood after considering a typical compression cycle: As the rotor rotates in a counterclockwise direction, gas is aspirated through the inlet port 71 (FIG. 5) and into compartment 81 between two adjacent vanes, the compartment having an average radial dimension D1. As the rotor rotates, the walls of the rotor and chamber effectively move toward one another accompanied by progressive inward movement of the rollers and vanes so that, as a given compartment approaches the outlet port 72, the radial dimension of the compartment, indicated at 82, has been reduced to an average distance D2, which is only a small fraction of the original dimension D1, the ratio of the two being a measure of the compression ratio. Upon slight additional movement of the rotor beyond the position illustrated in FIG. 5, the compressed gas from the chamber 82 is discharged through the outlet port 72.

It is typical of the construction that the active compression stroke occupies a major portion of the full revolution of the rotor. Thus as shown in FIG. 5 cut-off of the air flowing into the compartment 81 occurs short of the major axis. There then is more than 180 degrees of compression, with discharge from the compartment 82 being delayed until the leading vane defining the compartment engages the outlet port 72 which lies totally beyond the major axis, as related to the direction of rotor rotation.

It will be noted in FIG. 5 that the dimension D2 changes only slightly during the last sixty degrees or so of movement prior to encountering the outlet port (the angular distance between vanes of the last compartment ahead of the outlet port) providing an extremely shallow "ramp". There are several advantages to this: In the first place there is a high mechanical advantage in compressing the gas at high pressure, thereby causing a more constant torque loading over a complete rotative cycle. Secondly is the fact that the velocity of the transported gas, at the point of discharge, is substantially equal to the vane tip velocity, thereby producing a substantially constant rate of gas flow through the outlet port.

In mathematical terms the rate of change of volume of a compartment relative to angle of rotation, $dV/d\theta$, approaches zero over a substantial angle prior to the outlet port and right up to the point where the leading vane reaches the outlet port. This provides a gap of escape cross section, from the compartment, which is large, on the order of the cross section of the outlet port itself, so that there is effectively no restriction at the outlet port and hence low velocity of discharge. In short, there is a substantial absence of the "wire drawing" at the point of escape of the compressed gas which accounts, in part, for the lack of efficiency noted in compressors of more conventional design.

The combination of the elliptical chamber containing a circular rotor offset in two directions with roller-constrained vanes results in a described machine of high efficiency which has inherently low friction per pound of mass flow or per unit of swept displacement.

Due to the fact that the vanes are constrained by rollers, the inlet and outlet ports may be placed in the outer curved wall of the chamber and may extend the full axial width of the wall. Since the tips of the vanes do not touch the wall, the port area may be made as large as desired in contrast to vane type compressors in which the vanes are not constrained and in which the port must be formed of a bank of small holes so as to preserve as much supporting area for the tips of the vanes as possible. A machine of the design described is less sensitive to size "scale up" due to the fact that the port flow velocity is a function of the size of the machine to the third power whereas the port flow area is a function of the size of the machine only to the second power. Thus when scaling up the size, the fact that the ports are located at the periphery enables the size of the ports to be compensatingly increased, as necessary, without limitation. In other words the present construction may be scaled up as desired without paying the usual penalty in terms of increased friction and increased velocity of the discharged gas. As a result, the present design of compressor is ideally suited for use with vapor refrigerants of the high boiling point, low vapor pressure type, with the necessary through-put being obtained either by scaling up size or by operating the shaft at a higher speed, or by a combination of the two, while reaping the benefits of more liberal tolerances (clearances) within the machine and with substantial elimination of leakage, both internal and external, normally experienced in machines of the vane type.

Above, mention has been made of the fact that the vanes are constrained against outward movement so that no actual touching takes place at the tips of the vanes. It is a further feature of the construction that the rollers ride in grooves having opposed walls with the radially inward wall of the groove having substantially constant radial clearance with respect to the contained rollers, thereby to determine the amount that each vane can move radially inward. Thus in carrying out the invention the opposed walls 68, 69 of the grooves 67 are machined to exceed the roller diameter by a small amount which may be on the order of 0.03 inch but which may lie in the range of 0.060 inch to 0.005 inch. The surface 69 which limits the inward movement of the vanes is, for convenience, referred to as a "bumper" surface. The small permissible inward movement of the vanes is desirable under starting conditions since, on start-up, fluid is by-passed between adjacent compartments thereby limiting the starting torque. In other words, the torque required to turn the shaft is less upon breakaway and with the shaft rotating at a slow speed than it is later when the vanes are outwardly seated as a result of centrifugal force with the shaft driven at its rated speed. This low starting torque characteristic is particularly beneficial since it enables the compressor to minimize starting shock upon the driving source; for example, where the compressor is driven by an electric motor it is possible to use a conventional AC motor of the induction type rather than a more expensive "capacitor start" motor intended for driving of compressors.

The capability of the vanes to move a small distance inwardly also serves to protect the compressor against a condition usually referred to as "slugging" in which there may be fed into the inlet port of the compressor, not the usual vaporized gas, but a "slug" of refrigerant in the liquid state. Under such conditions the attempt of the compressor to compress a liquid results in sufficient pressure to lift the vanes away from the engaged curved surface, permitting safe escape of the liquid about the tip of the vane into the adjacent compartment thereby avoiding the build-up of a high pressure which is normally destructive of conventional machines.

Notwithstanding the ability of the vanes to move inwardly, the vanes are kept seated by a centrifugal force during all normal operation of the machine, and no auxiliary springs, or outwardly acting hydraulic forces, are required to maintain the vanes reliably seated. Indeed, it is contemplated that where minimizing starting torque is a prime consideration and where means are provided for normally operating the compressor at a high speed, auxiliary springs may be provided for normally biasing the vanes inwardly thereby to insure that each vane starts with a maximum clearance condition at the tip rather than relying upon gravity to achieve the inward movement.

Refinement of the above design of compressor has resulted in the setting of optimum values, or ranges, for the various design parameters. Analysis, confirmed by experience, has shown, for example, that the axial clearances of the vanes with respect to the end walls 23, 24 should preferably be about 0.002 inch but in any event operation within the range of 0.001 and 0.005 inch is recommended.

Further it is preferred that the aspect ratio of the rotor, that is, the length of the rotor as related to the diameter of the rotor fall within the range of 0.25 and 0.75; the optimum appears to be on the order of 0.5.

Studies of vane thickness have established that the range of vane thickness to rotor diameter should preferably lie between 0.025 and 0.075, with an optimum ratio being approximately 0.05. When the ratio is above the upper end of this range the vane becomes quite heavy imposing additional loads on the roller bearings and wasting volumetric capacity, whereas the use of vanes which are too thin makes it structurally difficult to "set in" a reliable axle assembly.

The tips of the vanes should preferably be rounded with the ratio of vane tip radius to vane thickness preferably being between 2.0 and 2.5.

The machine has been described with the inlet and outlet ports fixed and non-adjustable for constant throughput or heat rate when the device is used as a compressor in a refrigeration system. In co-pending application Ser. No. 157,564 mentioned above, an internal liner, or shoe, is provided which forms the curved outer wall of the chamber on the discharge side and which is peripherally adjustable to vary the pressure at which the gas is discharged and therefore the compression ratio of the compressor. The degree of eccentricity employed in the present construction is sufficiently gentle so that, if desired, a similar liner, or shoe, may be embodied in the present construction as a matter within the skill of the art in those applications where there is a need to adjust the pressure at discharge. Moreover, the liner, or shoe, may be automatically adjusted to bring about an automatic corrective variation in heat rate, thereby to maintain a constant temperature condition in a controlled space by using the control circuit which is set forth in the co-pending application and which is included herein by reference.

It is a feature of the present device, when used as a compressor in a refrigeration system, that it is not limited to use with fluorocarbons, such as freon, which constitute a hazard to global ecology but, on the contrary, the compressor is ideally suited for use with numerous other relatively harmless gases, particularly gases of low vapor pressure, such as isopentane, neopentane, isoamylene, or mixtures thereof.

The term "substantially elliptical" as applied to the profile of the curved surface 25 on the inlet and outlet sides, is intended to apply to a mathematical ellipse or the substantial equivalents thereof not, however, including profiles of which all or a portion thereof is circular. Substantial equivalents include profiles of the lemniscate, hypertrochoid or hypotrochoid type.

The term "single in and out stroke" as used herein refers to the fact that each vane undergoes a cycle of reciprocation only once per shaft revolution as compared to the "double stroking" which takes place in prior vane type devices having an elliptical stator. However, the term "single in and out stroke" is not to be strictly construed and includes constructions where the vane undergoes a pause, or a very slight, momentary reversal of movement at the center region of the primary reciprocation cycle.

The suitability of the machine to a wide variety of refrigerants, particularly to refrigerants of the high boiling point, low vapor pressure type has been mentioned. A preferred refrigerant is isoamylene since this refrigerant has many of the same characteristics as the fluorocarbon refrigerant R-11 but which is free of its well publicized hazards to the shielding, high level ozone layer. However, many other refrigerants may be employed such as pentane, isopentane or a mixture of the two.

Also while the device has been described as a compressor for the sake of uniformity throughout, drawing gas in and discharging it at higher pressure, the device is inherently capable of working as an expander, or motor, supplied with gas under high pressure at port 72 and with discharge at a lower pressure from port 71 accompanied by production of rotative power. When the device is employed as an expander, or motor, it enjoys high energy conversion efficiency as well as the other advantages set forth in the objects of the invention listed at the outset.

What we claim is:

1. A rotary compressor comprising in combination a housing defining a chamber having opposed parallel end walls and a curved outer wall, the outer wall having a reference region between inlet and outlet sides of the chamber, said inlet and outlet sides having a substantially elliptical profile having major and minor axes centered on the chamber axis, a rotor of cylindrical shape having a plurality of equally spaced radial grooves formed therein and having a shaft supporting the same for rotation in the housing, vanes profiled to fit the chamber and radially slidable in the grooves to define enclosed compartments between them, each vane having a pair of axially extending stubshafts having rollers respectively mounted thereon, roller tracks formed in the end walls of the chamber for accomodating the rollers and for guiding the vanes so that the profiled outer edges of the vanes follow the outer wall of the chamber in closely spaced engagement, means defining an inlet port on the inlet side of the chamber for aspiration of gas into a compartment and an outlet port on the outlet side for discharging gas from the compartment in the compressed state, the ports being located in the curved outer wall of the chamber and positioned to closely straddle the reference region, the rotor having its axis laterally offset from the chamber axis for sealing engagement at the reference region for sealing between the ports, the rotor axis being offset toward the outlet port and the rotor axis being spaced along both the major and minor axes of the elliptical profile by sufficient amounts that each vane undergoes but a single in and out stroke during each revolution of the rotor notwithstanding the elliptical nature of the chamber.

2. The combination as claimed in claim 1 in which the amount of offset along the major axis is approximately twice the amount of offset along the minor axis.

3. The combination as claimed in claim 1 in which the eccentricity of the elliptical profile lies within the range of 20 to 30 degrees.

4. A rotary compressor comprising in combination a housing defining a chamber having opposed parallel end walls and a curved outer wall, the outer wall having a reference region between inlet and outlet sides of the chamber, said inlet and outlet sides having a substantially elliptical profile having major and minor axes centered on the chamber axis, a rotor of cylindrical shape having a plurality of equally spaced radial grooves formed therein and having a shaft supporting the same for rotation in the housing, vanes profiled to fit the chamber and radially slidable in the grooves to define enclosed compartments between them, each vane having a pair of axially extending stubshafts having rollers respectively mounted thereon, roller tracks formed in the end walls of the chamber for accommodating the rollers and for guiding the vanes so that the profiled outer edges of the vanes follow the outer wall of the chamber in closely spaced engagement, means defining an inlet port on the inlet side of the chamber for aspiration of gas into a compartment and an outlet port on the outlet side for discharging gas from the compartment in the compressed state, the ports being located in the curved outer wall of the chamber and positioned to closely straddle the reference region, the eccentricity of the elliptical profile lying within the range of 15 degrees and 45 degrees, the rotor having its axis laterally offset from the chamber axis along both the major and minor axes so as to produce sealing engagement of the rotor at the reference region for sealing between the ports, and the rotor being sufficiently large so there are three positions about the circumference where the tangents to the rotor and the curved wall of the chamber are parallel to one another so that each vane undergoes but a single in and out stroke during each revolution of the rotor notwithstanding the elliptical nature of the chamber.

5. The combination as claimed in claim 1 or in claim 4 in which the rollers ride in grooves having opposed walls and formed in the respective end walls of the chamber with the radially outward wall of the groove serving as a roller track with the radially inward wall of the groove having substantially constant radial clearance with respect to the contained rollers thereby permitting each vane to move radially inward under start-up and in the face of "slugging".

6. The combination as claimed in claim 1 or in claim 4 in which the rollers ride in grooves having opposed walls and formed in the respective end walls of the chamber with the radially outward wall of the groove serving as a roller track with the radially inward wall of the groove having substantially constant radial clearance with respect to the contained rollers thereby permitting each vane to move radially inward under start-up and in the face of "slugging", the radial clearance lying between 0.005 inch and 0.060 inch.

7. The combination as claimed in claim 1 or in claim 4 in which the inlet portion extends, in the direction of rotor rotation, to a point of cut-off short of the major axis and the outlet port lies totally beyond the major axis, and in which the outlet port is unrestricted at the mouth opposite the tips of the vanes.

8. The combination as claimed in claim 1 or in claim 4 in which the rotor axis lies on a quadrant of an elliptical locus having a semi-major axis which is equal to the focal radius of the outer wall of the chamber, the elliptical locus having an elliptical eccentricity which is the complement of the eccentricity of said outer wall.

* * * * *